United States Patent [19]

del Castillo-Olivares

[11] 4,445,631

[45] May 1, 1984

[54] PATCH POCKET-FORMING, FOLDING AND SETTING APPARATUS

[76] Inventor: Fernando del Castillo-Olivares, 555 Blackwood St., Greenfield Park, Calif.X, 1H4

[21] Appl. No.: 383,366

[22] Filed: May 28, 1982

[51] Int. Cl.[3] ..... A41H 43/00; D05C 9/04

[52] U.S. Cl. ..... 223/1; 112/2; 112/121.15; 223/38; 223/52

[58] Field of Search ..... 223/1, 38, 52; 112/2, 112/121.15

[56] References Cited

U.S. PATENT DOCUMENTS

| | | | |
|---|---|---|---|
| 2,094,528 | 9/1937 | Daughters | 112/2 |
| 3,143,091 | 8/1964 | Arbter | 112/2 |
| 3,191,557 | 6/1965 | Moore | 112/2 |
| 3,277,851 | 10/1966 | Dobner et al. | 112/2 |
| 3,335,682 | 8/1967 | Tucci | 112/2 |
| 3,528,378 | 9/1970 | Westhoff et al. | 112/121.15 |
| 3,552,336 | 1/1971 | Brandriff | 112/121.15 |
| 3,713,406 | 1/1973 | Futter | 112/121.15 |
| 3,749,038 | 7/1973 | Dodsworth | 112/121.15 |
| 4,034,689 | 7/1977 | Hintzen et al. | 112/68 |
| 4,079,681 | 3/1978 | Bianchi | 112/121.15 |
| 4,337,881 | 7/1982 | Off | 223/1 |

*Primary Examiner*—Louis Rimrodt

[57] ABSTRACT

There is disclosed an apparatus which forms and folds a precut pocket patch and sets it in position on a garment panel, ready to be sewn by an adjacent sewing machine. The apparatus comprises a holding blade on which a precut pocket patch is manually positioned, and a pocket patch-forming and folding assembly located over the holding blade. The latter and the assembly are vertically movable one with respect to the other and to an underlying garment panel support table. The assembly includes a forming plate, having a flat underface and a downwardly-extending rim at its periphery creating a cavity to receive the pocket patch; the latter is clamped and its margin creased by the rim about the edge of the holding blade. The assembly further carries around its periphery folding blades which move inwardly underneath the holding blade to complete the folding of the pocket patch. The contour of the holding blade and of the plate cavity corresponds to the desired contour of the folded patch. The folded pocket patch is pressed down on the garment panel; the folding blades retract outwards, and the forming and folding assembly moves up and the holding blade keeps the patch on the garment panel until the conventional sewing clamp engages the patch, at which time the holding blade is retracted. The sewing clamp then transfers the assembled pocket and garment panel to the sewing station, ready for sewing.

12 Claims, 20 Drawing Figures

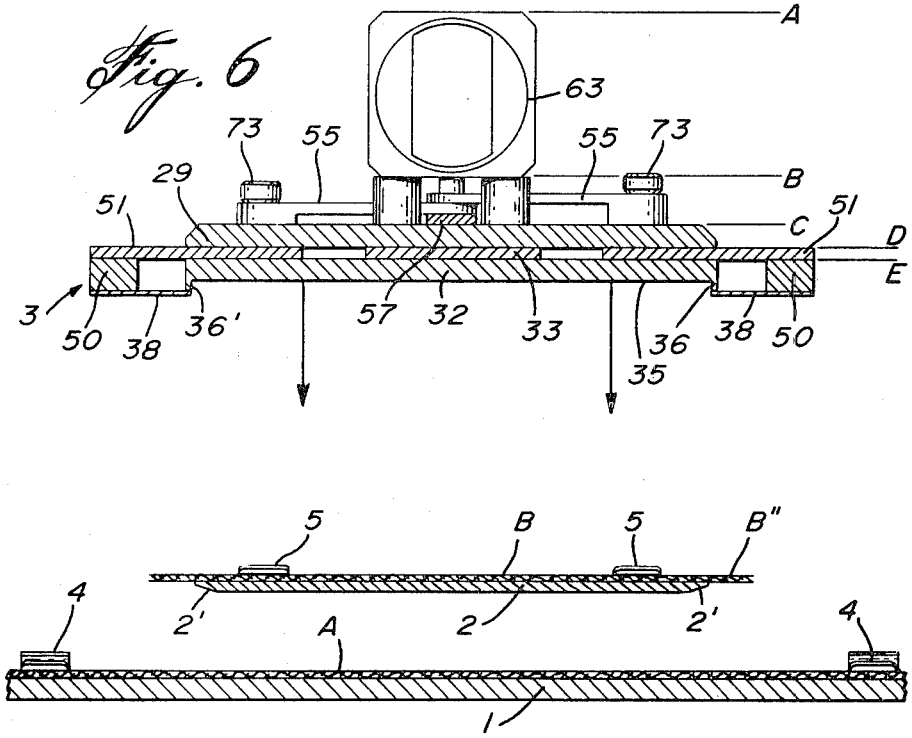
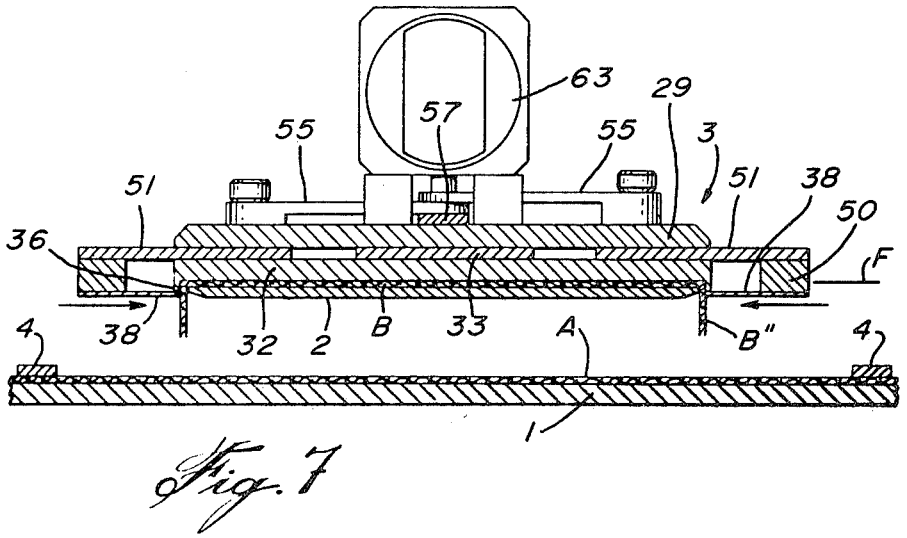
Fig. 7

Fig. 8
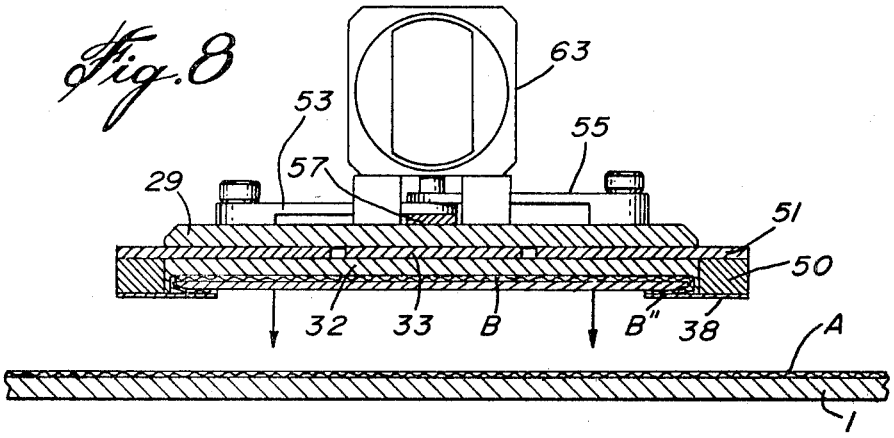
Fig. 9
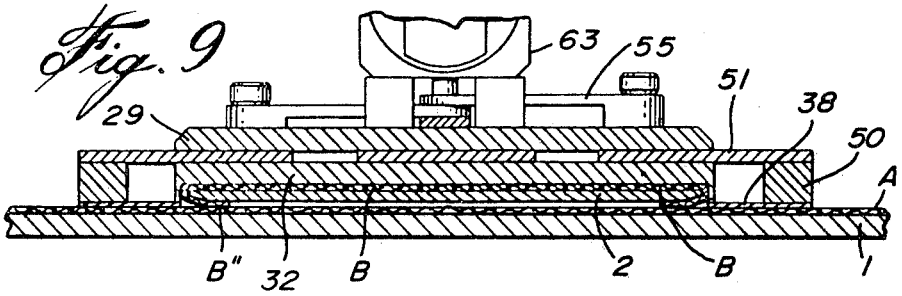
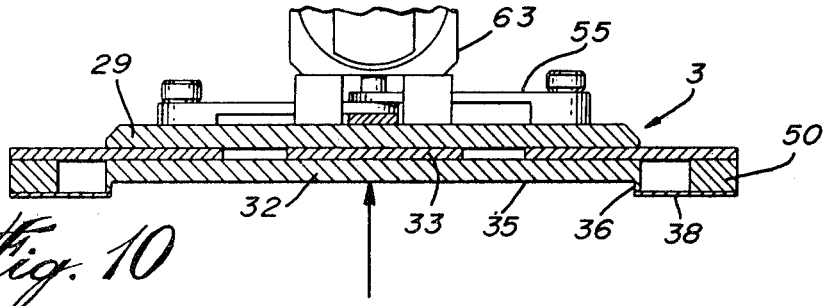
Fig. 10
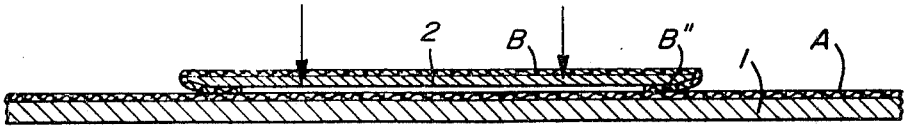

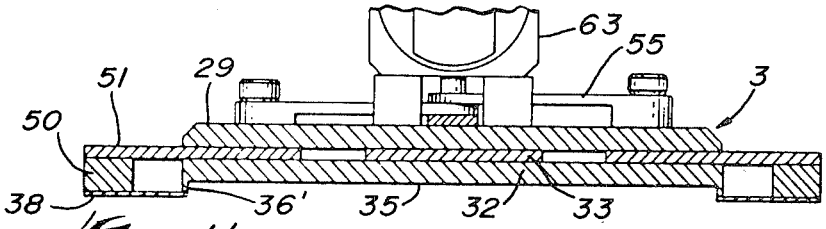
Fig. 11
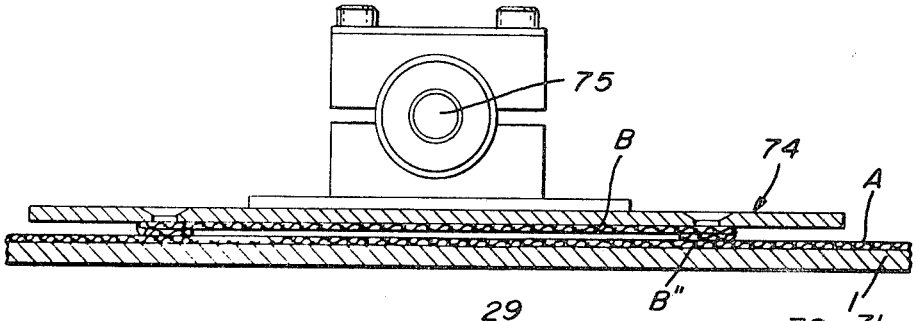
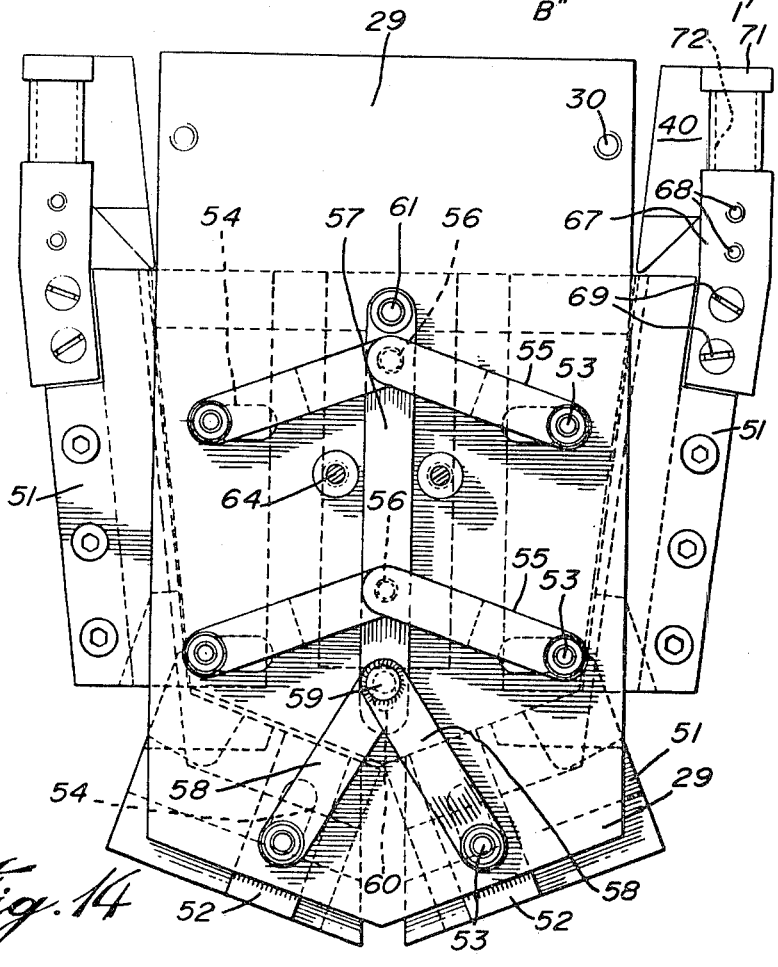
Fig. 14

PATCH POCKET-FORMING, FOLDING AND SETTING APPARATUS

FIELD OF THE INVENTION

The present invention relates to a patch pocket-forming, folding and setting apparatus.

BACKGROUND OF THE INVENTION

Known apparatuses of the above type include a holding blade to support a precut pocket patch thereon with its margin protruding from the blade, a pressure plate movable down over the holding blade to hold the patch in position and a separate frame surrounding the pressure plate and independently moving downwardly to fold the pocket patch margin around the holding blade and carrying folding blades to finally fold the patch.

It has been found very difficult with such an arrangement to properly fold the pocket patch to the required final shape and to apply it to the underlying garment, ready for sewing. The separate mounting and movement of the frame carrying the folding blades requires additional mechanisms with sufficient precision for the proper positioning of this frame with respect to the holding blade and pressure plate. It frequently results that the patch pocket is improperly shaped and its folding margin improperly folded.

Most pocket shapes require several folding blades: in known apparatuses, these blades are actuated by cylinder and piston units via an array of links and levers, resulting in a complicated and expensive means to effect the proper folding sequence.

When patterned fabric is used, the pattern in the garment panel must be aligned to the pattern on the pocket patch, in which case the external frame may obstruct the field of vision.

OBJECTS OF THE INVENTION

It is therefore the object of the invention to provide an apparatus of the character described, which first forms and subsequently folds a precut pocket patch to the exact contour desired, using a very simple mechanism and which sets the formed and folded pocket patch on the garment panel in a position ready for sewing.

Another object of the invention is to provide an apparatus of the character described, in which the pocket patch is being formed prior to the folding and setting operations, all steps being carried out automatically and very quickly.

Another object of the invention resides in the provision of a pocket patch-forming and folding assembly requiring a minimum of mechanical parts.

Another object of the invention is to provide a system of the character described, in which the apparatus can be very quickly replaced by another for a different pocket shape.

Another object of the invention is the inherently-unobstructed field of vision whereby the patterned fabric of the garment panel can be readily aligned with the patterned fabric of the pocket.

SUMMARY OF THE INVENTION

The patch pocket-forming, folding and setting apparatus in accordance with the invention comprises a holding blade for supporting a precut pocket patch and a patch-forming and folding assembly superposed over said holding blade and an underlying work surface supporting the garment panel over which the pocket patch is to be applied and eventually sewn. The assembly includes a pocket patch-forming plate having a substantially flat underface and a downwardly-extending rim at its periphery which defines a cavity in which the pocket patch and the holding blade are inserted. The rim causes automatic initial forming of the marginal portion of the pocket patch. The assembly carries also the folding blades which are movable between a retracted outward position and an operative inward position underlying the plate and holding blade and causing final folding of the marginal portion of the pocket patch.

The above-described holding blade and assembly are supported for independent movement above the work surface. Therefore, the garment panel can be positioned on the work surface and a pocket patch on the raised holding blade. Thereafter, the forming and folding assembly descends on the pocket patch and holding blade to initially form the patch around the blade, so that the margin of the patch is now at substantially right angles to the work surface. The folding blades carried by the assembly complete the folding. Then the assembly and the holding blade continue to descend as a unit onto the garment panel on the work surface. The holding blade presses the folded pocket patch down on the garment panel; the folding blades retract outwards and the folding and forming assembly moves up to leave space for the conventional sewing clamp to engage over the folded pocket patch and holding blade and press the same against the garment panel. The holding blade is then retracted from within the pocket and the sewing clamp transfers the pocket patch and garment panel to the sewing area to be sewn together. At the same time, the holding blade moves forward to leading position and is ready to receive another pocket patch.

The invention is also directed to the manner of actuating the folding blades on the forming and folding assembly by means of a simple toggle linkage, operated by a single double-acting cylinder, to move the folding blades in the required timing sequence.

The foregoing will become clearer by referring to the annexed drawings.

BRIEF DESCRIPTION OF THE DRAWINGS

FIG. 6 is a cross-section, taken along line 6—6 of FIG. 1, showing the forming and folding assembly and the holding blade in their fully-raised position with respect to the sewing table;

FIGS. 7, 8, 9, 10, and 11 are sections similar to that of FIG. 6, but showing the sequence of movements for clamping, forming and folding the pocket patch and setting it up in position on the garment panel and then allowing the conventional sewing clamp to engage the folded pocket patch and garment panel for the transfer of the same to an adjacent sewing station (not shown);

FIG. 14, seen on the page containing FIG. 11, is a top plan section of the forming and folding assembly, taken at the level B of FIG. 6;

DETAILED DESCRIPTION OF PREFERRED EMBODIMENT

Figure 1:
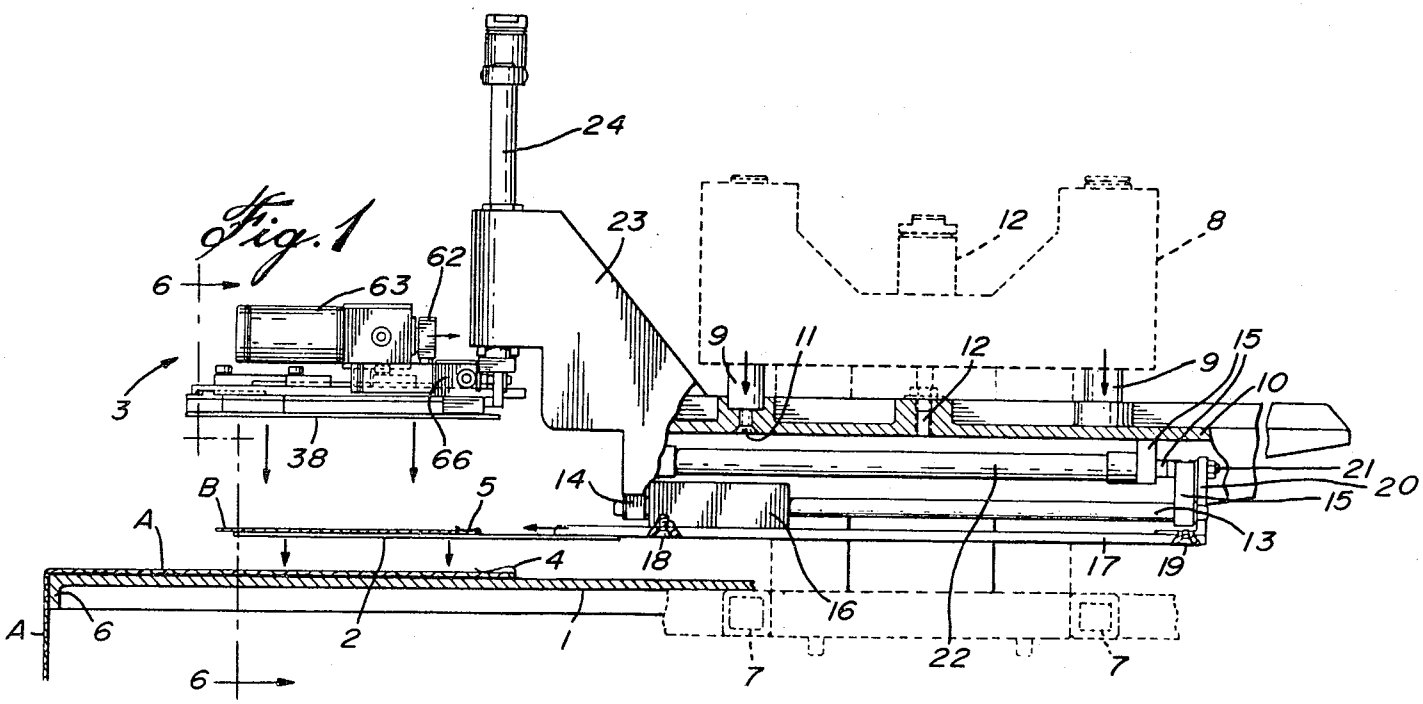
FIG. 1 is a side elevation of the patch pocket-forming, folding and setting apparatus in accordance with the invention, the forming and folding assembly, together with the holding blade, being shown in their fully-raised position with respect to the sewing table, and with the pocket patch and garment panel in position ready to start the automatic cycle.

As shown in FIG. 1, above the work surface or sewing table 1, is positioned a holding blade 2, and superposed with respect to holding blade 2 is the forming and folding assembly, generally indicated at 3. The garment panel A onto which a pocket patch B is to be positioned is placed on the work table 1 and held by suitable clamps 4, which may be spring clamps but, preferably, remote-controlled clamps. The pocket patch 8 is manually placed in proper position on the holding blade 2 and retained thereon by means of spring clips 5. The front edge of the sewing table 1 is indicated at 6.

Means support the blade 2 and the assembly 3 in vertical registry and for vertical up-and-down movement one with respect to the other and with respect to the sewing table 1. These means include a support frame which consists of a pair of cantilevered arms 7, shown in FIGS. 1 and 3, firmly secured to the sewing table frame at their lower end and interconnected at their upper end by a head 8. This head carries four vertical guide rods 9 slidable within the head 8, and supporting at their lower ends a subframe 10, which is secured to the guide rods by bolts 11. The sub-frame 10 is movable up and down under the action of a central double-acting vertical cylinder and piston unit 12 carried by the head 8. The sub-frame 10 carries a pair of horizontal guide rods 13 extending from the front to the back of sewing table 1, guide rods 13 being secured to the sub-frame 10 and 14 and by bracket 15. Movable and guided by guide rods 13 is a block 16 incorporating linear recirculating ball bearings and in turn holding a horizontal support plate 17 by means of bolts 18. The support plate 17 is held at its rear end by bolts 19 to a bracket 20, itself secured to the rear free end of the piston rod 21 of a double-acting horizontally-disposed cylinder and piston unit 22 carried underneath the sub-frame assembly 10. The rear end of the holding blade 2 is adjustably secured to the front end of the support plate 17.

It will be understood that the holding blade 2 can be moved forwardly and rearwardly with respect to the sewing table 1 and sub-frame 10 by means of the double-acting cylinder 22. The holding blade 2, during this movement, is accurately guided by block 16 and guiding rods 13. In FIG. 1, the holding blade 2 is in its advanced position. When blade 2 is fully retracted, block 16 abuts bracket 15.

Up-and-down movement of the sub-frame 10 by means of vertical cylinder unit 12 will move the holding blade 2 between its raised position, shown in FIG. 1, and a lowered position flat against the garment panel A on the sewing table 1.

The sub-frame 10 is extended forwardly by means of an integral front sub-frame portion 23, which movably carries a pair of vertical, parallel guide rods 24, to the lower end of which is secured a cross-member 25 (see FIG. 3), to the underside of which the rear end of the assembly 3 is removably secured. A vertical double-acting cylinder and piston unit 26 is carried by the front sub-frame portion 23 and its piston rod 27 is secured to the cross-member 25, whereby operation of this cylinder unit 26 will cause up-and-down movement of the assembly 3 with respect to the sub-frame 10 and, consequently, with respect to the holding blade 2.

Figure 3:
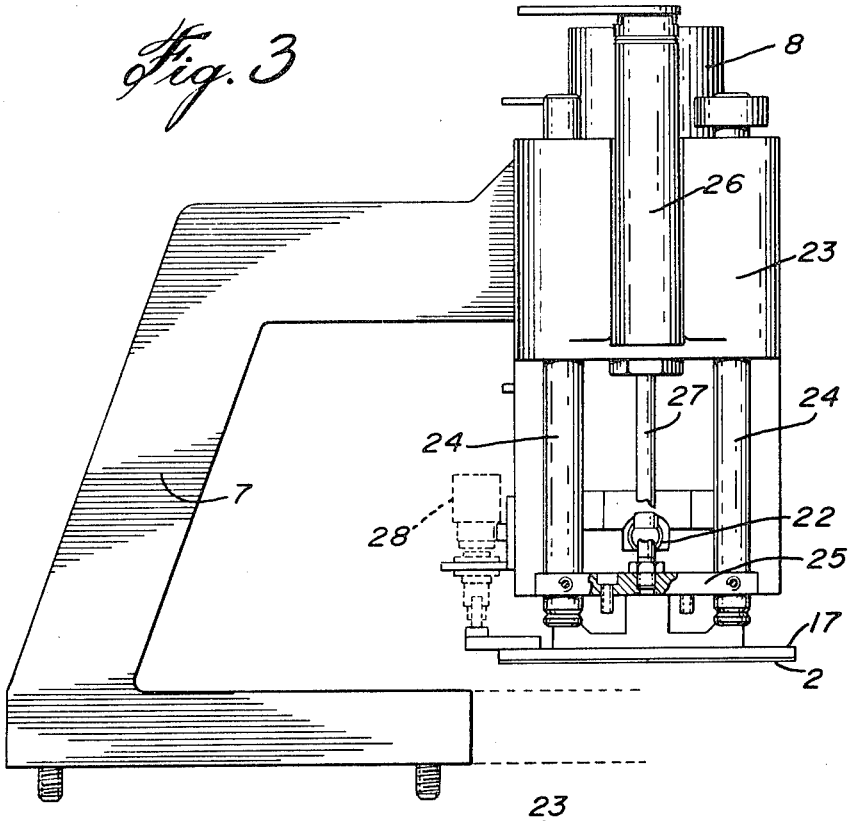
FIG. 3 is a front end elevation of the apparatus shown in FIG. 1, with the forming and folding assembly removed.
Figure 4:
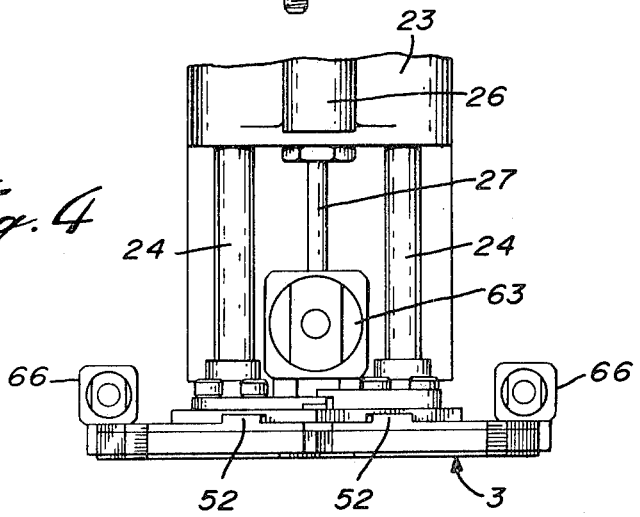
FIG. 4 is a partial front elevation with the forming and folding assembly in position.

Suitable limit switches, such as that shown at 28 in FIG. 3, for the horizontal movement of holding blade 2, are part of a control system, not shown, which operates the apparatus in an automatic manner. The movements of the blade 2, assembly 3, together with its folding blades, will be described later on.

Figure 2:
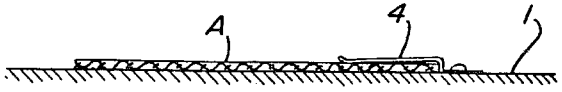
FIG. 2 is a cross-section of the sewing table and part of the garment panel held thereon, on an enlarged scale.

Referring to FIGS. 1 and 2, it will be noted that the cantilevered arrangement of the supporting frame 7, 8 for the apparatus enables to position a garment panel A well rearwardly on the sewing table 1, whereby giving great freedom of choice for the location of the pocket patch B on the garment.

Figures 12, 13, 13A:
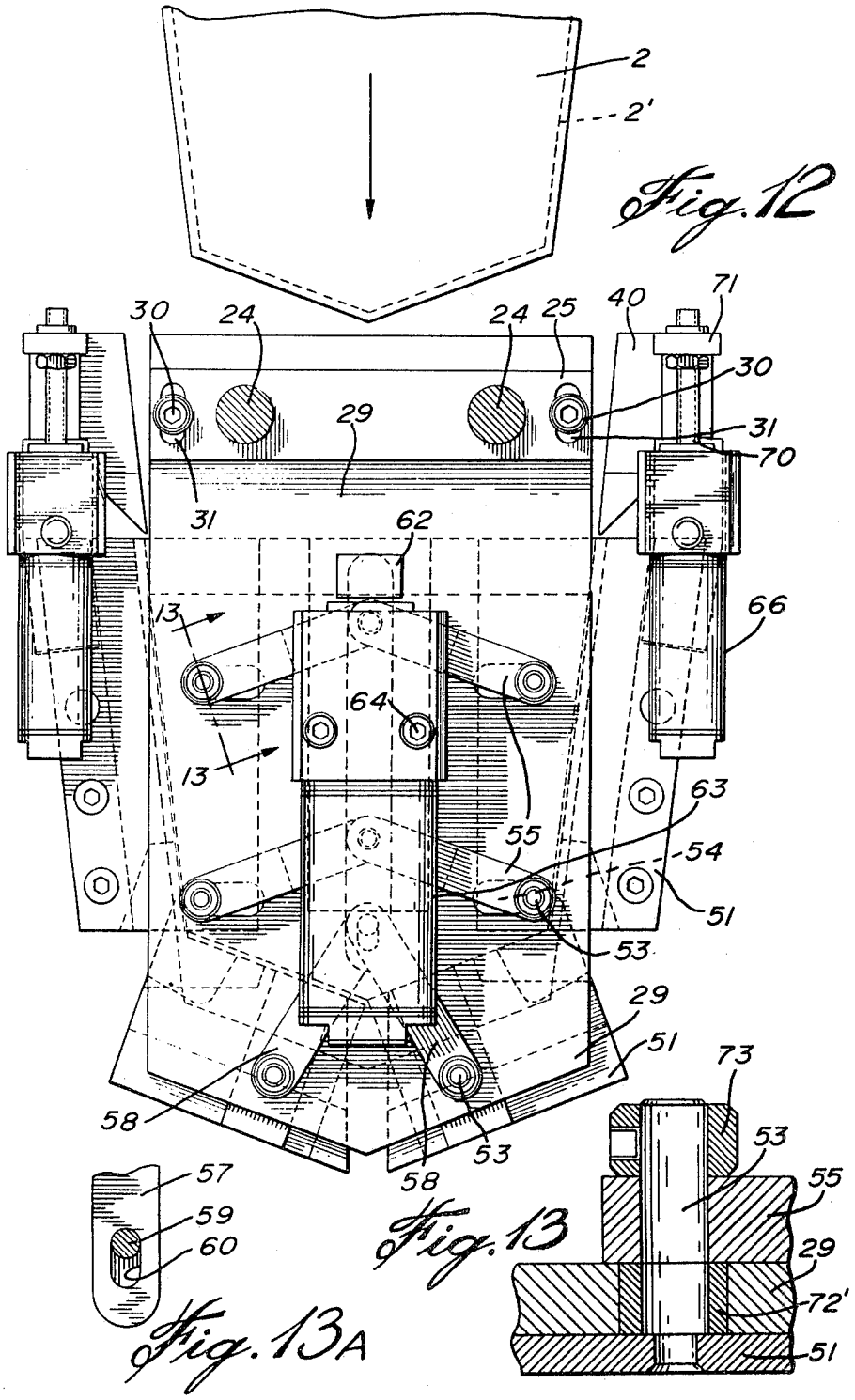
FIG. 12 is a top plan view, taken at level A of FIG. 6, also showing the holding blade in the process of advancing to its operative position in vertical register with and under the assembly.
FIG. 13 is a cross-section, taken along line 13—13 of FIG. 12.
FIG. 13*a* is an enlarged view of the center link and its lost motion connection to the links of the pocket bottom-folding blades, as shown in FIG. 12.
Figure 15:
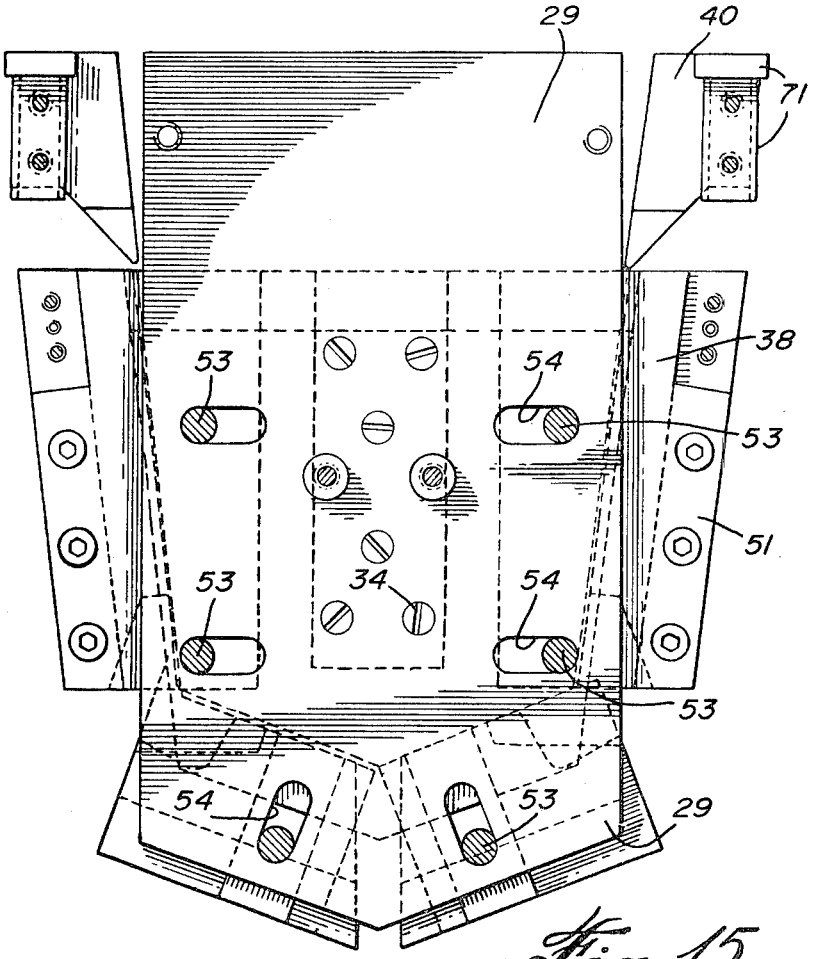
FIGS. 15, 16, and 17 are top plan sections of the forming and folding assembly, at levels C, D, and E, respectively, of FIG. 6.

The pocket patch-forming and folding assembly 3 is shown in cross-section in FIG. 6 and in top plan view in FIG. 12 and in different plan sections in subsequent FIGS. 14 to 18. This assembly includes a top plate 29 secured underneath cross-member 25 by means of bolts 30 engaging slots 31 of the cross-member 25, whereby the top plate can be accurately oriented with respect to the holding blade 2. To the underside of top plate 29 is secured a lower plate 32 with the interposition of a spacer strip 33. As shown in FIG. 15, screws 34 secure the top plate 29, lower plate 32 and strip 33 together.

In accordance with an essential feature of the invention, the lower plate 32 is substantially flat at its underface 35 and is provided at its contour with a downwardly-extending rim 36 defining a cavity of sufficient depth to receive the holding blade 2 with a pocket patch B overlying the latter and folded around and underneath the same. The distance between the inside faces 36' of rim 36 of the lower plate 33 is sufficient to receive the holding blade 2 with sufficient clearance for the thickness of the formed fabric of the pocket patch B. Obviously, the rim 36 is absent at the pocket opening.

Figure 18:
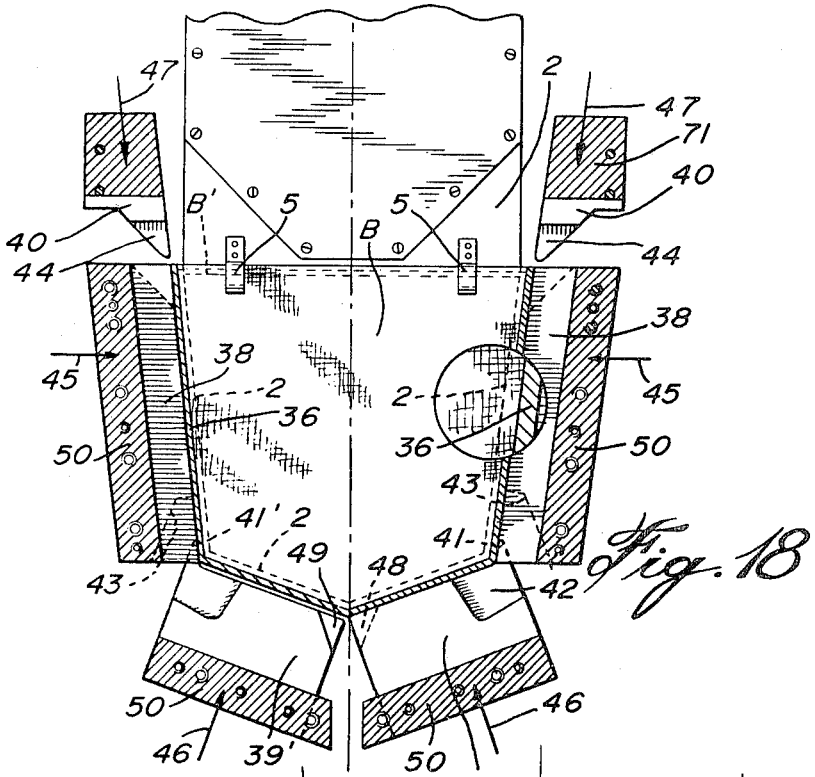
FIG. 18 is a top plan section, taken at level F of FIG. 7, showing the holding blade and patch in position.
Figure 19:
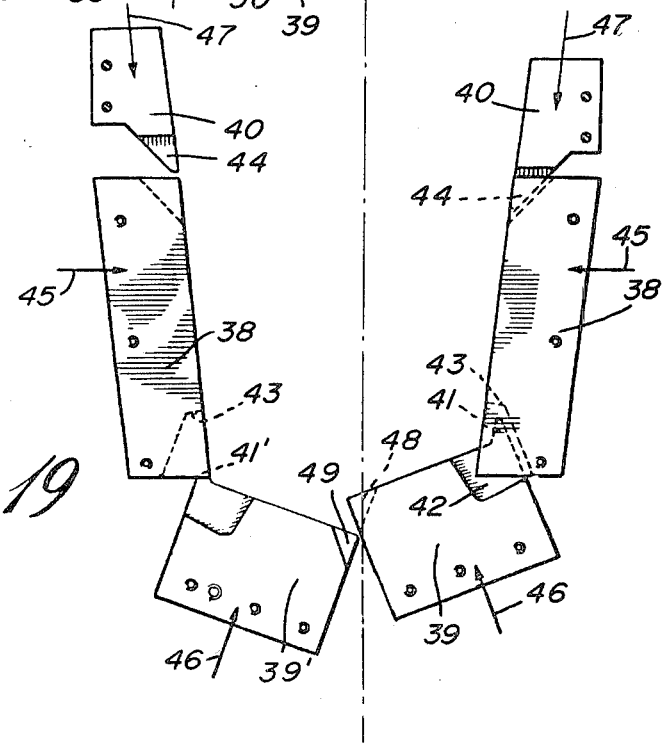
FIG. 19 is a top plan view of the folding blades only, shown retracted at the left and advanced at the right of the center line of the assembly.

In accordance with the second feature of the invention, the assembly of the top plate and lower plate carries the folding blades for the final step of the folding operation of the pocket patch around the holding blade 2. As shown in FIG. 18, for the specific shape of a pocket to be made, there are two side folding blades 38 and two pocket bottom-folding blades 39 and 39' making an angle to each other, so as to form a V-shape bottom pocket. Finally, there are two tucking blades 40 to tuck the corners at the pocket opening. In FIG. 18, all of the blades are shown in fully-retracted position, in which, as shown in FIGS. 6 and 7, their free edges overlap and are flush with the inside face 36' of the rim 36 of the lower plate 32. This rim is shown in plan section FIG. 18, with the folder blades extracted further than in reality to expose the rim in plate 33.

FIG. 18 also shows the holding blade 2 and the pocket patch B overlying the same, with its edge already creased downwardly, as shown in FIG. 7, and with the pocket patch B held by spring clips 5. Obviously, as shown, the contour of the rim 36 and of the holding blade 2 corresponds to the final shape of the pocket B.

In the embodiment shown, the two bottom-folding blades 39 and 39' underlie the side-folding blades 38. The two bottom blades 39 and 39' have at their outer corner a tucking projection 41, which is part of a portion 42 of reduced thickness of the blade and which engages a recess 43, made at the under side of the side blades 38. Similarly, the top corner of the side blades 38 is cut at an angle and forms a recess at its underface, adapted to receive the tucking projection 44 of reduced thickness of the tucking blades 40.

In the fully-retracted position of the blades, the free edges of the side blades 38 and of the right-hand bottom-folding blade 39 are flush with the inside face of the rim 36. However, the left-hand bottom-folding blade 39' is narrower than the right-hand folding blade 39, so that its free edge is spaced outwardly from the inside face of the rim 36 to introduce a delay in the folding operation of this blade with respect to the blade 39. The two side blades 38 are adapted to move simultaneously inwardly while remaining parallel to themselves, as indicated by arrows 45. The bottom blades 39, 39' are adapted to move inwardly in accordance with arrows 46, while the tucking blades 40 are adapted to move towards the side blades in accordance with arrows 47.

The two side blades 38 move first, thereby folding the marginal portion of the pocket patch B from a hanging position, shown in FIG. 7, to a folded position underneath the holding blade 2, as shown in FIG. 8.

The right-hand bottom-folding plate 39 moves after a first delay. Tucking projection 41 is first inserted underneath the already-made side fold to define a clear folding edge. Then the bottom blade 39 folds the pocket patch material over the tucking projection 41, therefore making a clear cut and neat three-layer fold at the bottom corner of the pocket. Finally, the left-hand folding blade 39' moves in; the two bottom blades overlap at their inner corners 48 and 49 to make a neat three-layer fold, and the left-hand blade 39' folds the last bottom marginal portion of the pocket patch underneath the right-hand bottom marginal portion. The projection 41' of the blade 39' makes a tucking at the left-hand bottom corner of the pocket patch.

The tucking blades 40 are moved independently by separate power means, with a suitable time delay, to tuck the end corners of the pocket opening.

Figure 16:
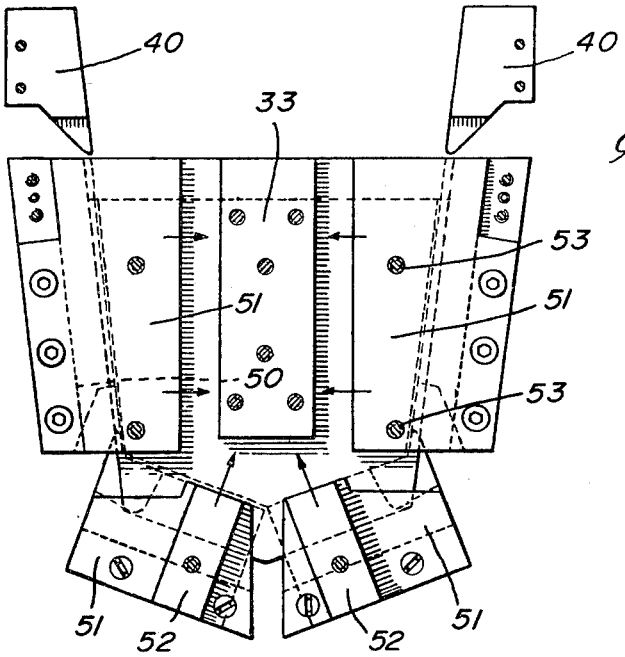
Figure 17:
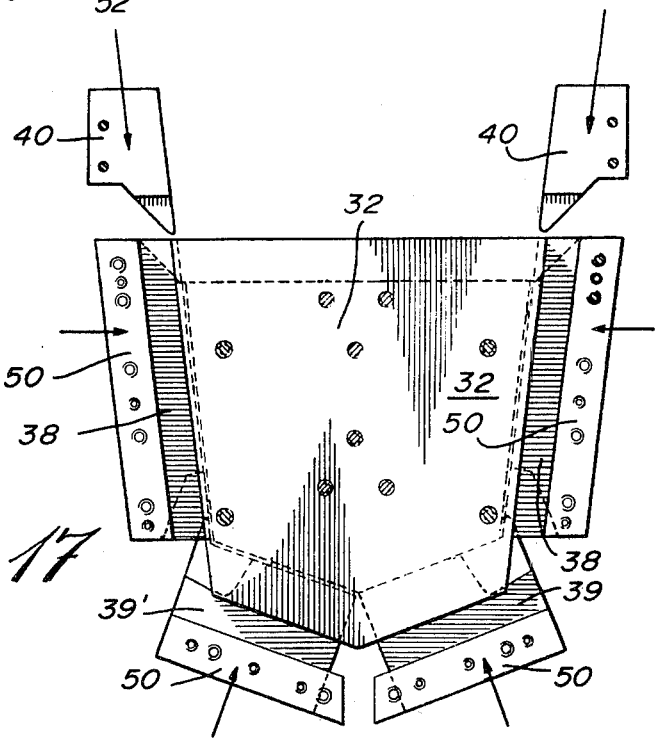

The outer marginal portions of the folding blades 38, 39, and 39' are secured to the underside of spacer bars 50, as shown in FIGS. 6 and 18. These spacer bars are in turn secured to the underside of guide plates 51, as shown in FIG. 16, and in FIG. 6.

Each guide plate 51 is horizontally guided between top and lower plates 29 and 32. The guide plates 51 of the bottom-folding blades 39 and 39' are further provided, on top of the same, with guide strips 52 engageable with similarly-directed grooves made at the underside of the top plate 29, so as to maintain the two bottom-folding blades 39, 39' parallel to themselves during their outward and inward movement.

Each guide plate 51 is provided with an upstanding pin 53 secured thereto and extending through a slot 54, made in the top plate 29. There are two pins 53 and two corresponding slots for the side blades in order to maintain the same parallel to themselves during their movement. This is clearly shown in FIG. 15. The upper end of the two pins 53 for each side-folding blade 38 is pivotally connected to a toggle link 55 (see FIGS. 12, 13, and 14). The inner ends of said toggle links 55 are pivotally connected at 56 to a center link 57. The pin 53 of the two bottom-folding blades 39, 39' is connected to the outer end of a link 58; the inner ends of the two links 58 are connected together by a pin 59 which engages a slot 60, made at the forward end of the center link 57 (see FIG. 12 and also FIG. 13*a*). The rear end of the center link 57 is connected by a pin 61 to a block 62 secured to the piston rod of a double-acting air cylinder 63 located centrally of the assembly 3 and secured on the top plate 29 by means of bolts 64.

As clearly shown in FIG. 12 wherein the cylinder piston rod is in retracted position with all of the blades in retracted position, it will be understood that movement of the piston rod towards the top of the figure and of its cylinder will pull on the links 55 and then with a delay on the links 58 due to the presence of slot 60 in the center link 57. The pins of the two side-folding blades 38 will travel towards the inner end of slots 54 and, thus, the folding blades 38 will make their inward folding movement while remaining parallel to themselves. The bottom-folding blades 39 and 39' remain parallel to themselves, because they are guided by guide strips 52 (FIG. 16).

With this arrangement, the side blades move in first, then the right-hand bottom-folding blade 39 and, finally, the left-hand blade 39', as previously described.

FIG. 12 shows two double-acting air cylinders 66 for moving the tucking blades 40. Each cylinder 66 is secured to a bracket 67 by bolts located at 68 (see FIG. 14) and bracket 67 is in turn secured to guide plate 51 by bolts 69. Piston rod 70 of cylinder 66 is secured to an L-shaped bracket 71 (see FIGS. 12 and 14), the horizontal leg of which forms at its underside a dovetailed tongue 72 slidable and guided in a dovetailed groove of bracket 67. It follows that the tucking blades 40 are mounted on the assemblies of the side blades 38 to accurately cooperate with the latter.

As shown in FIG. 13, each pin 53 is provided with a roller 72' for smoother movement in the slots 54. The links 55 are held on the pins 53 by means of locking collars 73.

Figure 5:
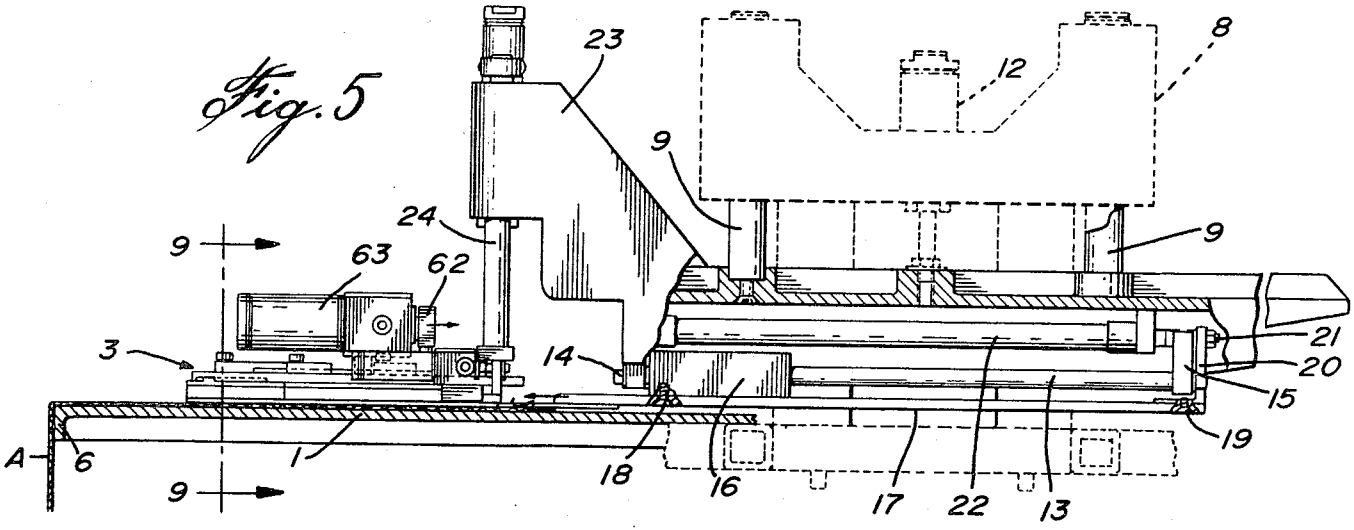
FIG. 5 is a side elevation similar to that of FIG. 1, but showing both the forming and folding assembly and the holding blade in fully-lowered position onto the sewing table.

The apparatus operates as follows:

With the machine in the position shown in FIGS. 1 and 5, the operator first centers a hemmed and precut pocket patch B onto the holding blade 2, so that it is retained in position at the hemmed top end B' (FIG. 18) by the clips 5, which serve also as patch locators on blade 2. Therefore, patch B protrudes equally from blade 2 all around the latter, except at the hemmed top end B'.

Then the operator puts the garment panel A on the table surface 1, the latter being retained in place by clamps 4. Obviously, if the garment panel must be pushed further rearwardly, there is room for the same, as seen in FIGS. 1 and 3. In this case, the clamps 4 will be at the back of the work table and can be remotely operated.

If the fabric of the garment and pocket has stripes, the operator positions the garment panel A, so that its stripes will match the stripes on the pocket. Then the operator initiates, by means of push button switches, the fully-automatic cycle of the machine. The pocket-forming and folding assembly 3 descends over the pocket patch B and the holding blade 2, as shown in FIG. 7, whereby the bottom surface of the lower plate 32 of assembly 3 clamps the pocket patch B onto the holding blade and the rims 36 form the creased edge of folding margin B″ of the pocket patch along precisely the contour of the holding blade 2, and folding marginal portion B″ then hangs downwardly at substantially right angles to the table surface 1, as shown in FIG. 7. The holding blade 2 acts as a punch engaging the cavity formed by the rim 36. The rim has a slight clearance with the edge of the folding blade 2 to accommodate the thickness of the patch B. Thus, the pocket patch is now formed and is tightly folded around the holding blade 2 by means of the rim 36. Then, as shown in FIG. 8, the folding blades 38, 39, and 39′ and, finally, the tucking blades 40 are actuated in the above-described sequence, whereby the folding margin B″ of the pocket patch B is tightly finally folded against the underside of the holding blade 2, which is preferably bevelled at the underside of its edge, as shown at 2′, to facilitate the final folding step. During this time, the group consisting of the holding blade 2, patch pocket B and forming and folding assembly 3 continues to descend toward the garment panel A on the table surface 1 and is finally applied against the garment, as shown in FIG. 9. At this stage, the folding blades 38, 39, 39′ fully retract and the assembly 3 starts to rise, while the holding blade 2 firmly presses the formed and folded pocket patch onto the garment panel, as shown in FIG. 10.

With the forming and folding assembly 3 at its fully-raised position, the conventional sewing clamp 74, which is carried by an arm 75, moves over the set pocket, as shown in FIG. 11, and then presses the pocket against the garment panel A and the sewing table 1. Once this is effected, the holding blade 2 is retracted through the pocket opening B′ by means of air cylinder 22, as shown in FIG. 2. Then the sewing clamp 74 is free to transfer the assembly of the preset and prefolded pocket B and garment panel A along the sewing table to an adjacent sewing station, not shown. After transfer of the pocket and garment, the holding blade moves upwardly and then forwardly to its initial position, ready for the next pocket forming and folding operation, while the preceding pocket is being sewn. The cycle is repeated.

For each pocket shape, size and/or material thickness, a different holding blade and forming and folding assembly 3 is required. These two sub-assemblies can be easily and quickly disconnected from their support and replaced by an appropriate set without any subsequent adjustment.

It will be noted that the holding blade 2 and assembly 3 move strictly vertically, while remaining parallel to themselves, and parallel to the sewing table 1, and they are held against lateral pivoting movement. Therefore, they can be precisely maintained in registry during all of their movements, resulting in precise forming and folding of the pocket patch. The whole operation is effected very quickly and completely automatically. All the machine movements are controlled via solenoid pneumatic valves, by a suitable electronic control system, which can be programmed.

What I claim is:

1. A patch pocket-forming, folding and setting apparatus comprising:

(a) a holding blade for holding a precut pocket patch with the folding margin of said pocket patch extending beyond the edge of said holding blade, all around except for the pocket opening;

(b) a patch-forming and folding assembly comprising a lower plate having a substantially flat underface and a downwardly-extending rim at the periphery of said lower plate, except in the region of said pocket opening, to define a cavity at said underface, the contour of said holding blade and of the inside of said rim of said lower plate corresponding to a folded pocket;

(c) means to support said holding blade and said assembly one below the other, with said holding blade and underface substantially parallel, horizontal and in register, from the end corresponding to said pocket opening;

(d) means to raise and lower said holding blade and said assembly while in registry independently of one another, said holding blade insertable within said cavity upon relative movement of said blade and assembly toward each other, thereby the folding margin of said pocket patch is caused to be shaped and creased downwardly by said rim, with the main portion of said pocket patch sandwiched and clamped between said underface and said holding blade;

(e) folding blades carried by said forming and folding assembly for inward and outward movement relative to the same between a retracted outward position clearing the inside of said rim and inward position underlying the underface of said holding blade; and (f) means to cause inward and outward movement of said folding blades to fold the downwardly-extending margin of said pocket patch inwardly around the edge of said holding blade and under the latter during said inward movement.

2. An apparatus as claimed in claim 1, further including means to mount said holding blade and said forming and folding assembly above a working surface, means on said working surface to removably fix a garment panel thereon underneath said holding blade and assembly, said means to raise and lower said holding blade and assembly capable of lowering the same and pressing the same as a group against the garment panel on the working surface, and means to retract said holding blade through said pocket opening while said pocket patch is pressed down on said garment panel.

3. An apparatus as defined in claim 2, wherein said means to support and said means to raise and lower said holding blade and said assembly, and said means to retract said holding blade, comprise a support frame secured to said working surface and upstanding therefrom, a sub-frame carried by said support frame for vertical up-and-down movement, means to move said sub-frame with respect to said support frame while said sub-frame remains parallel to itself, said assembly being carried by said sub-frame for vertical up-and-down movement while remaining parallel to itself and parallel to the said working surface, power means to raise and lower said assembly with respect to sub-frame, said holding blade being carried by said sub-frame for horizontal front and back movement while remaining parallel to itself and power means to move said holding blade forwardly and rearwardly with respect to said sub-frame.

4. An apparatus as claimed in claim 3, wherein said support frame includes a frame head held in cantilevered position over said working surface by vertically-curved arms secured to said working surface at their lower end, said sub-frame being disposed underneath said head and above said working surface, wherein in the raised position of said holding blade, a garment panel is free to extend rearwardly under said holding blade and said sub-frame.

5. An apparatus as defined in claim 1, wherein said forming and folding assembly further includes an upper plate, a spacer interconnecting said upper and lower plates at the central portion thereof and leaving a space on the sides of said spacer, guiding plates guided and movable within said last-named space, said folding blades carried at the underside of said guiding plates.

6. An apparatus as claimed in claim 5, wherein said means to cause inward and outward movement of said folding blades include a single double-acting cylinder and piston unit mounted on said top plate and a toggle lever arrangement interconnecting the piston rod of said unit and said folding blades.

7. An apparatus as claimed in claim 6, wherein there are two opposite side-folding blades disposed along the sides of said lower plate to fold the sides of said folding margin and there is at least one bottom-folding blade disposed across said lower plate at the end opposite said pocket opening to fold the bottom of the folding margin of said pocket patch, and said toggle lever arrangement includes a center link directly connected to the piston rod of said unit, a pair of toggle links interconnecting said center link with each of said side-folding blades, an additional link interconnecting said bottom-folding blade with said center link, the connection of said additional link to said center link being a lost motion connection to cause a delay of the inward folding movement of said bottom-folding blade with respect to the inward folding movement of said side-folding blades, whereby the sides of the folding margin of the pocket patch are first folded and then the bottom of the folding margin of the pocket patch is folded underneath said sides.

8. An apparatus as claimed in claim 7, wherein there are two separate bottom-folding blades making an obtuse angle with respect to each other, there being a link interconnecting each bottom-folding blade with said center link with said lost motion connection between the last two named links and said center link, and wherein one of said bottom-folding blades is narrower than the other, so that it starts folding the pocket patch after said other bottom-folding blade.

9. An apparatus as claimed in claim 8, wherein said bottom-folding blades have corner portions overlapping each other and overlapping adjacent ends of said side-folding blades during inward movement of said folding blades to tuck the folds at the corners of said pocket patch.

10. An apparatus as claimed in claim 9, further including tucking blades movable in and out of the corners of the pocket patch at the pocket opening and independent power means operating said tucking blades, said tucking blades and power means being carried by said guide plates for said side-folding blades.

11. An apparatus as claimed in claim 10, further including means to maintain said side-folding blades and said bottom-folding blades parallel to themselves during their reciprocating inward and outward movement with respect to said lower plate.

12. A patch pocket-forming, folding and setting apparatus comprising a sewing table, means for removably clamping a garment panel onto said sewing table, support arms secured to said table and upstanding therefrom, a support frame head held over said sewing table in cantilevered relationship with respect to said support arms, first vertical guide rods movable up and down in said head, a sub-frame carried by the lower ends of said guide rods, first power means for reciprocating said sub-frame up and down with respect to said head and sewing table, second horizontal guide rods supported by said sub-frame under the same, a support movably carried by said horizontal guide rods, second power means to reciprocate said support horizontally under said sub-frame, a holding blade carried by the forward end of said support and forwardly extending therefrom, said holding blade being horizontally disposed above said sewing table, means on said holding blade to removably clamp thereon, a precut pocket patch in flat condition with the folding margin of said patch projecting outwardly from the sides of said holding blade not connected to said support, said holding blade movable up and down by vertical movement of said sub-frame and movable horizontally forwardly and rearwardly of said table by movement of said support along said second guide rods, said sub-frame having a forward extension disposed over said holding blade, a pair of third vertical guide rods movable vertically up and down within said forward sub-frame extension, a cross-piece interconnecting the lower ends of said third guide rods, third power means interconnected between said sub-frame forward extension and said cross-piece to move said cross-piece vertically up and down, a pocket patch-forming and folding assembly having a rear and removably affixed to said cross-piece, said assembly including horizontally-disposed upper and lower plates, a spacer member between the central portion of said plates and interconnecting the same, said plates defining around their sides and front end a guiding space therebetween, said lower plate having a flat underface surrounded by a downwardly-protruding rim defining a cavity at said underface, said cavity having the exact contour of said holding blade, with a clearance corresponding substantially to the thickness of the material of said pocket patch, said holding blade entering wholly within said cavity, guide plates slidably inserted and guided within said space between said top and bottom plates of said assembly, folding blades carried by said guiding plates and extending horizontally, inwardly in contact with the underside of said rim, and power means carried by said top plate and operatively connected to said guide plates to move said guide plates and, therefore, said folding blades between a retracted outward position wherein the free edge of said folding blades clear the inside of said rim and an operative inward position wherein the free edge of said folding blades overlaps the holding blade inserted within said cavity, said second guide rods and said third guide rods holding said holding blade and said assembly, respectively, in vertical registry one below the other above said sewing table, said third guide rods capable of maintaining said assembly in an upper position spaced above said holding blade, said sub-frame taking an upper position maintaining said holding blade above said sewing table to enable positioning of the pocket piece onto said holding blade and a garment panel onto said sewing table, respectively, said third guide rods and associated third power means capable of lowering said assembly onto said holding blade, to thereby clamp a pocket patch on said holding blade and form the folding margin of said pocket patch downwardly by means of said rim, said folding blades then capable of moving inwardly to fold said margin underneath said holding blade, the group of said assembly and folding blade and clamped and folded pocket patch then capable of moving downwardly and pressing against the garment panel on said sewing table, said folding blades capable of retraction while the folded margin of said pocket patch is still pressed by said holding blade on said garment panel, then said assembly capable of moving upwardly to its upper limit position to allow a sewing clamp to press down on said pocket patch, said second power means capable of retracting said holding blade through said pocket opening, while said sewing clamp presses down said pocket patch on said garment panel.

* * * * *